US006173762B1

(12) United States Patent
Ishida et al.

(10) Patent No.: US 6,173,762 B1
(45) Date of Patent: Jan. 16, 2001

(54) HEAT EXCHANGER TUBE FOR FALLING FILM EVAPORATOR

(75) Inventors: Seiji Ishida, Tokyo; Tomio Higo; Tetsuo Uchida, both of Hatano; Masahiro Furukawa, Oizumi-machi; Masashi Izumi, Ora-machi; Kazuhiro Yoshii, Oizumi-machi, all of (JP)

(73) Assignees: Kabushiki Kaisha Kobe Seiko Sho, Kobe; Sanyo Electric Co., Ltd., Moriguchi, both of (JP)

( * ) Notice: Under 35 U.S.C. 154(b), the term of this patent shall be extended for 0 days.

(21) Appl. No.: 08/271,635

(22) Filed: Jul. 7, 1994

(30) Foreign Application Priority Data

Jul. 7, 1993 (JP) ..... 5-167852

(51) Int. Cl.[7] ..... F28F 13/18

(52) U.S. Cl. ..... 165/133; 165/184; 165/181; 165/179

(58) Field of Search ..... 165/184, 179, 165/133, 181

(56) References Cited

U.S. PATENT DOCUMENTS 4,168,618 * 9/1979 Saier et al. ..... 165/184 X
4,549,606 * 10/1985 Sato et al. ..... 165/184 X
4,658,892 * 4/1987 Shinohara et al. ..... 165/184 X
4,660,630 * 4/1987 Cunningham et al. ..... 165/133
4,715,436 * 12/1987 Takahashi et al. ..... 165/133
5,010,643 * 4/1991 Zohler ..... 165/133 X
5,353,865 * 10/1994 Adiutori et al. ..... 165/133

FOREIGN PATENT DOCUMENTS

3332282 * 3/1984 (DE) ..... 165/184
0100396 * 6/1984 (JP) ..... 165/184

OTHER PUBLICATIONS

U.S. application No. 09/008,080, filed Jan. 16, 1998, pending.
U.S. application No. 09/013,206, filed Jan. 26, 1998, pending.

* cited by examiner

*Primary Examiner*—Christopher Atkinson
(74) *Attorney, Agent, or Firm*—Oblon, Spivak, McClelland, Maier & Neustadt, P.C.

(57) ABSTRACT

A heat exchanger tube for a falling film evaporator has fins provided on the outer periphery of the tube body and extending in a direction transverse or in oblique to the axial direction of the tube. The fins have heights in a range of 0.2 to 0.8 mm. The fins are arranged in a density to have 905 to 1102 in number of fins per 1 m in the axial direction. Grooves formed in the tip end of the fins and extending substantially along the fins, the mutually opposing inner peripheral wall surface of the groove defining an angle within a range of 70° to 150°. Cut-outs formed in the tip end of the fins, the cut-outs being provided at a pitch in a range of 0.5 to 1.0 mm. With this construction, the heat exchanger tube for the falling film evaporator which exhibits a high refrigerant wetting and spreading ability as well as large surface area for providing remarkably improved heat transmission performance.

11 Claims, 8 Drawing Sheets

HEAT EXCHANGER TUBE FOR FALLING FILM EVAPORATOR

BACKGROUND OF THE INVENTION

1. Field of the Invention

The present invention relates to a heat exchanger tube for a falling film evaporator suitable to employ in the falling film evaporator of an absorption refrigeration machine and so forth.

2. Description of the Related Art

In a falling film evaporator employed in absorption water cooling and heating appliance and so forth, a refrigerant flows down along the outer peripheral surface of a heat exchanger tube for performing heat exchanging with a media to be cooled, such as water, flowing through the tube, for cooling the medium. The refrigerant contacting with the heat exchanger tube spreads on the surface of the heat exchanger tube with wetting the latter and evaporates under low pressure to remove heat from a heat transmission surface of the heat exchanger tube to cool the water as the medium to be cooled, in the tube. Upon evaporation of the refrigerant spread on the surface of the heat exchanger tube, vaporization heat is removed from the heat transmission surface so that the water or so forth in the tube can be efficiently cooled. Therefore, in order to attain high performance heat exchanger tube, it is necessary to increase the contact area between the refrigerant and the heat exchanger tube (namely, the area of the heat transmission surface) as great as possible.

Increasing of the contact area between the refrigerant and the heat exchanger tube may be achieved by increasing the surface area of the heat exchanger tube and by enhancing refrigerant spreading ability in spreading of the cooling water with wetting the surface of the heat exchanger tube. As the conventional heat exchanger tube with the increased surface area, there are a flute tube which has grooves formed on the external surface of the tube along the tube axis, and a low fin tube which is provided with collar-like or spiral fin or fins on the external surface of the tube. On the other hand, as the heat exchanger tube having an improved refrigerant wetting and spreading ability, there is a surface treated tube having a smoothed external surface and a surface treated tube having the external surface treated by wire brush polishing. Also, as the heat exchanger tube which can achieve both of the increased external surface area and improved refrigerant wetting and spreading ability, there is proposed a high performance heat exchanger tube, in which cut-outs are formed in the fins arranged on the external surface of the tube in alignment in the tube axis direction (Shuichi Takada "*RecentAbsorption Refrigeration Machine and Heat Pump* (3)", March, 1989).

However, above-mentioned conventional heat exchanger tubes encounter the following problems. Namely, in the case of the surface treated tube with smoothed or polished external surface, when the refrigerant drops on the surface of the tube, the refrigerant may widely spread with wetting the external surface of the tube in the area near the drop point. However, the refrigerant has a tendency to converge toward the tube axis direction as flowing down along the external surface of the heat exchanger tube to lower wetting and spreading ability. In case of the flute tube, since the refrigerant flows in the tube axis direction along the grooves to achieve higher wetting and spreading ability in comparison with the above-mentioned surface treated tube. However, at ridge portions between the adjacent grooves, no wetting and spreading ability can be obtained. Therefore, the heat transmission area of the whole heat exchanger tube cannot be satisfactorily large. On the other hand, in the case of low fin tube, while the surface area of the external surface of the tube can be increased by the presence of fins arranged on the outer periphery of the tube, the wetting and spreading ability of the refrigerant inherently becomes small since motion of the refrigerant in the tube axis direction is blocked by the fins. Furthermore, though the high performance heat exchanger tube, in which cut-outs are formed in the fins, can achieve certain level of gain in improving the heat exchanging performance, it does not achieve the satisfactorily level of gain of the heat exchanging performance, yet. In the recent years, needs for further higher performance of absorption type water cooling and heating appliance. In order to satisfy such needs, it is strongly desired to have a further improved performance of the high performance heat exchanger tube.

SUMMARY OF THE INVENTION

Therefore, it is an object of the present invention to provide a heat exchanger tube for a falling film evaporator which holds high refrigerant wetting and spreading ability and has increased heat transmission area to provide improved heat transmission performance superior to the conventional heat exchanger tubes.

In order to accomplish the above-mentioned and other objects, a heat exchanger tube, according to the present invention, has fins extending transversely or in oblique to the tube axis direction, on the external surface. Groove portions extending along the fins are formed on the tip end portion of respective fins. In addition, a plurality of cut-outs are formed on the tip end portion of the fins at a predetermined pitch in the circumferential direction of the tube, in alignment in the transverse direction to the fin extending direction.

When a refrigerant, such as water, is dropped on the heat exchanger tube constructed as set forth above, the refrigerant droplets are captured by the fins on the heat exchanger tube and thus flows in circumferential direction along the groove. In addition, the refrigerant further flows in axial direction of the heat exchanger tube along the aligned cut-outs. The refrigerant past through the cut-outs finally enters into bottom portion defined between the fins to flow from the upper side to the lower side of the tube. As set forth above, in the heat transmission tube, according to the present invention, since the refrigerant can be propagated through the grooves formed on the tip end portion of the fins, the cut-outs transversely formed at a predetermined pitch on the tip end portion of the fins in axial and circumferential direction of the tube. Therefore, the refrigerant flowing on the external surface of the heat exchanger tube will never cause local concentration of the refrigerant in propagation on the tube surface. Accordingly, the heat exchanger tube according to the present invention can achieve large contact area between the refrigerant and the heat exchanger tube, permits effective use of the increased surface area of the tube by formation of the fins, and whereby achieves excellent heat transmission performance.

Here, in the preferred construction, 905 to 1102 of fins are required for 1 m of axial length of the heat exchanger tube. In either case where the number of fins per 1 m of axial length of tube is less than 905 or greater than 1102, the refrigerant wetting and spreading ability is potentially lowered to cause degradation of the heat transmission performance. Therefore, the preferred range of density of the fins is 905 to 1102 fins per 1 m of axial length of the heat exchanger tube.

On the other hand, the preferred height of the fin is in a range of 0. 2 mm to 0.8 mm. In either case where the height of the fin is less than 0.2 mm or greater than 0.8 mm, the wetting and spreading ability of the refrigerant can be lowered. Therefore, 0.2 mm to 0.8 mm of height is required for the fins in the heat exchanger tube according to the invention.

Also, when an angle defined by both side peripheries of the groove is less than 70° or greater than 150°, the wetting and spreading ability of the refrigerant is lowered. Therefore, the preferred range of angle defined by the opposing peripheral walls of the grove is in a range of 70° to 150°.

Furthermore, the preferred pitch of the cut-outs in the circumferential direction of the tube is 0.5 mm to 1.00 mm. When the circumferential pitch of the cut-outs is smaller than 0.5 mm, difficulty should be encountered in formation of the cut-outs. On the other hand, when the circumferential pitch of the cut-outs exceeds 1.00 mm, the wetting and spreading ability of the refrigerant can be lowered, Therefore, the preferred range of pitch to form the cut-outs on the tip ends of the fins is 0.5 mm to 1.00 mm.

It should be noted that a rib or ribs may be provided in the heat exchanger tube extending internally from the inner periphery of the tube. Such rib or ribs may serve to stir the fluid (e.g. water) flowing through the tube to contributes improving heat transmission performance. In such case, when the ratio h/Di of the height h of the rib versus the maximum internal diameter Di of the tube is smaller than 0.02, noticeable stirring effect by the rib cannot be obtained and thus the performance cannot be improved. On the other hand, when h/Di is greater than 0.04, significant difficulty may be encountered in formation of the rib. Also, when a ratio $P_R$/Di of a pitch $P_R$ versus Di is smaller than 0.4, pressure loss of the cool water or so forth flowing through the tube becomes significant to require increased power for a pump which circulates the cool water. On the other hand, when $P_R$/Di is greater than 1.0, no noticeable stirring effect can be obtained to make it impossible to improve the heat transmission performance.

As set forth above, the heat exchanger tube according to the present invention has large surface area, avoids local concentration in spreading of the refrigerant flowing on the external surface of the tube, and holds high wetting and spreading ability of the refrigerant. Therefore, the heat exchanger tube according to the present invention achieves significantly high heat transmission performance.

BRIEF DESCRIPTION OF THE DRAWINGS

The present invention will be understood more fully from the detailed description given herebelow and from the accompanying drawings of the preferred embodiment of the present invention, which, however, should not be taken to be limitative to the present invention, but are for explanation and understanding only.

In the Drawings

DETAILED DESCRIPTION OF THE PREFERRED EMBODIMENTS

Next, the preferred embodiment of the present invention will be discussed more concretely with reference to the accompanying drawings. In the following description, numerous specific details are set forth in order to provide a thorough understanding of the present invention. It will be obvious, however, to those skilled in the art that the present invention may be practiced without these specific details. In other instances, well-known structures are not shown in detail in order not to unnecessary obscure the present invention.

Figure 1:
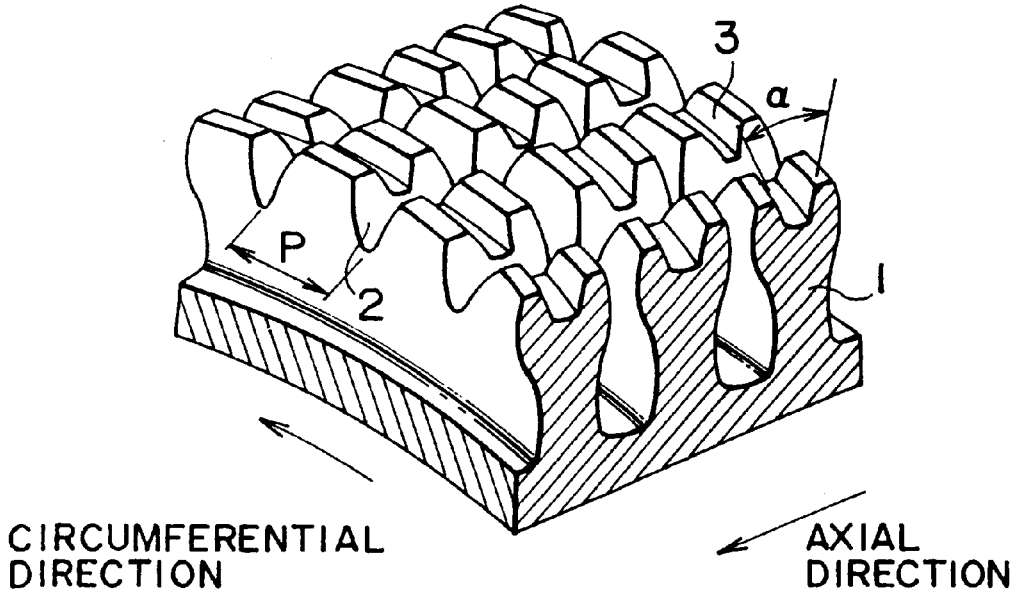
FIG. 1 is a fragmentary partial perspective view showing the first embodiment of a heat exchanger tube for an evaporator according to the present invention.

FIG. 1 is a fragmentary partial perspective view of the first embodiment of a heat exchanger tube for a falling film evaporator, according to the present invention. As can be seen, a plurality of fins 1 are provided on the outer periphery of the heat exchanger tube transversely or in oblique to a tube axis direction. In the preferred construction, number of the fins 1 provided in the unit length (e.g. 1 m) is 905 to 1102. The height of each individual fin 1 is set in a range of 0.2 to 0.8 mm. In the tip end portion of the fin 1, a groove 3 is formed therealong. An angle $\alpha$ defined by the both sides inner peripheral surfaces of the groove 3 is set in a range of 70 to 150°. Also, in the tip end portion of the fins 1, a plurality of cut-outs 2 are formed transversely to the fins. A circumferential pitch of the cut-outs 2 is selected in a range of 0.5 to 1.0 mm. Respective of cut-outs 2 in respective fins 1 are aligned in the axial direction of the tube with the cut-outs at the corresponding angular position in the adjacent fins.

In the shown embodiment of the heat exchanger tube for the falling film evaporator, a refrigerant (e.g. water) dropped from the above of the heat exchanger tube is captured by the upper half of the heat exchanger tube. The refrigerant flows down along the grooves 3 in circumferential direction. At the same time, the refrigerant captured on the upper half of the heat exchanger tube also flows along the cut-outs 2 in the axial direction. The tip end of the fin 1 is compressed to slightly protrude in the axial direction during the process of formation of the groove 3 to form the bulged tip end configuration as seen. As a result, the distance between the chip-ends of the mutually adjacent fins 1 becomes shorter than the original distance where the grooves 3 are not formed. Therefore, the distance between the chip-ends of the fin 1, which are divided by the groove 3, is almost same as the distance between the chip-ends of the adjacent fins 1. Thus, local concentration of the refrigerant in the axial direction can be avoided more effectively. As set forth above, in case of the flute tube, while the refrigerant flows in the tube axis direction along the grooves to achieve higher wetting and spreading ability, local concentration of the refrigerant is inherently caused according to flowing down of the refrigerant from the upper portion to the lower portion of the tube. On the other hand, in the case of low fin tube, while local concentration of the refrigerant can be successfully avoided, the wetting and spreading ability of the refrigerant inherently becomes small since motion of the refrigerant in the tube axis direction is blocked by the fins. In contrast to these prior art, since the axially aligned cut-outs 2 are formed in addition to the groove 3 extending along the circumferentially extending fin 1, the refrigerant can be widely spread or propagated in the axial direction with avoiding converging of the refrigerant as flowing down from the upper portion to the lower portion of the tube.

Namely, the shown embodiment of the heat exchanger tube for the falling film evaporator have large heat transmission area by providing the fins on the outer periphery, and provides high refrigerant wetting and spreading ability to achieve large refrigerant-tube contact area. Therefore, the shown embodiment of the heat exchanger tube can achieve remarkably high heat transmission efficiency.

Figure 2:
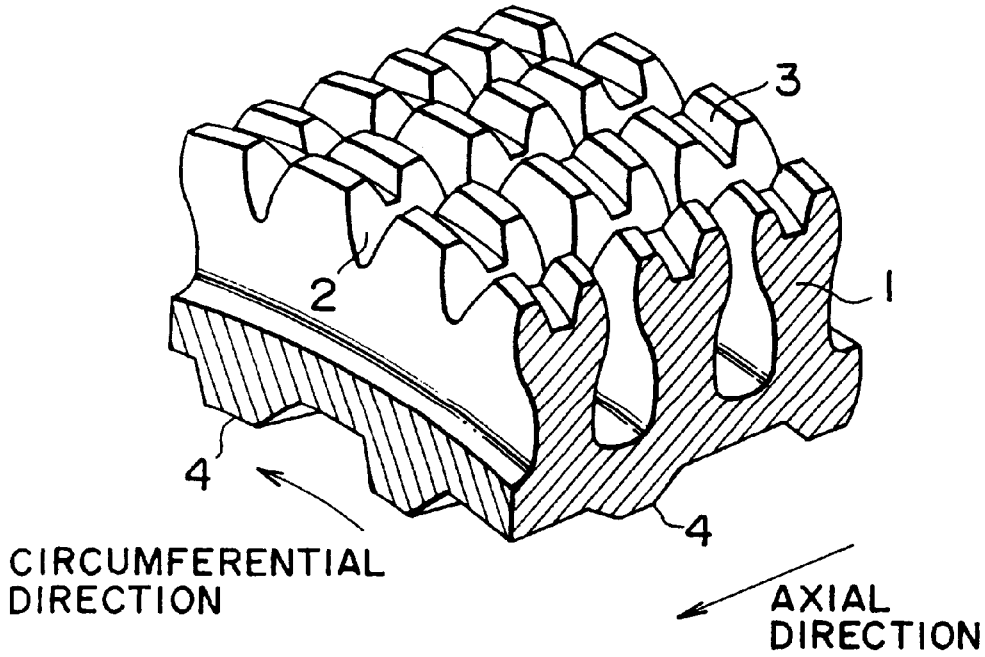
FIG. 2 is a fragmentary partial perspective view showing the second embodiment of a heat exchanger tube for an evaporator according to the present invention.

FIG. 2 is a fragmentary partial perspective view of the second embodiment of the heat exchanger tube for the falling film evaporator according to the present invention.

The shown embodiment of the heat exchanger tube is differentiated from the first embodiment in presence of a rib 4. Other construction of the tube is substantially the same as that of the first embodiment set forth above. In FIG. 2 like reference numerals represent like elements of FIG. 1.

As can be seen, in the shown embodiment, the rib 4 is provided on the inner periphery of the tube. In the shown construction, the rib extends in spiral fashion about the axis of the tube. In the preferred dimension, the height of the rib 4 is in a range of 0.25 mm to 0.5 mm, number of ribs per one turn along an inner peripheral surface of the tube is 8 to 30, a ratio h/Di of the height h of the rib 4 versus the maximum internal diameter Di is in a range of 0.02 to 0.04, and a ratio $P_R$/Di of the spiral pitch $P_R$ of the rib and Di is in a range of 0.4 to 1.0.

In the shown embodiment of the heat exchanger tube for the falling film evaporator, since the rib 4 is provided on the inner periphery of the tube and the rib 4 extends in oblique to the axial direction, a turbulent flow of the fluid is generated in the tube to improve heat transmission performance within the tube. Therefore, the shown embodiment of the heat exchanger tube for the falling film evaporator may achieve further higher heat transmission performance in comparison with that of the foregoing first embodiment.

Next, discussion will be given for the result of testing of the wetting and spreading ability and the heat transmission performance with respect to actually produced the shown examples of the heat exchanger tubes. Namely, the first example of the heat exchanger tube for the falling film evaporator of FIG. 1 and comparative examples with different fin configurations were produced for testing. With respect to the example and comparative examples, comparative test, e.g. heat exchange performance and so forth, was performed simulating the actually installed condition.

The dimensions of the example and comparative examples of the heat exchanger tubes for the falling film evaporator are show in the following table 1. It should be noted that, in table 1, the wording "original tube portion" represents the portion of the tube, such as the axial end portions, where no fin is provided. It should be further noted that all of the sample tubes are formed from a steel tube (C1201; JIS H3300).

It should be further noted that the examples 2, 3 and 4 and comparative examples 1 and 5 are a sample tube group, which are constructed in the same construction and dimensions except for the number of fin. The examples 6, 7, 8 and 9 and the comparative examples 10 are a sample group, which are mutually differentiated in the height of fins. Examples 13 and 14 and the comparative examples 12 and 15 are a sample group, in which the angles α defined by the inner peripheral walls of the groove are differentiated. Examples 16, 17 and 18 and the comparative example 19 are a group, in which the arrangement pitches of the cut-outs are differentiated. It should be noted that the comparative example 11 is a smooth tube having no fin.

TABLE 1

| | Original Tube Portion | | Processed Portion | | | |
|---|---|---|---|---|---|---|
| Sample Tube | External Diameter (mm) | Thickness (mm) | Fin Number (/m) | Fin Height (mm) | Groove Angle α (°) | Cut-Out Pitch (mm)) |
| Comparative 1 | 16 | 1.0 | 748 | 0.5 | 90 | 0.62 |
| Example 2 | 16 | 1.0 | 906 | 0.5 | 90 | 0.62 |
| Example 3 | 16 | 1.0 | 1024 | 0.5 | 90 | 0.62 |
| Example 4 | 16 | 1.0 | 1102 | 0.5 | 90 | 0.62 |
| Comparative 5 | 16 | 1.0 | 1339 | 0.5 | 90 | 0.62 |
| Example 6 | 16 | 1.0 | 1024 | 0.2 | 90 | 0.62 |
| Example 7 | 16 | 1.0 | 1024 | 0.3 | 90 | 0.62 |
| Example 8 | 16 | 1.0 | 1024 | 0.5 | 90 | 0.62 |
| Example 9 | 16 | 1.0 | 1024 | 0.8 | 90 | 0.62 |
| Comparative 10 | 16 | 1.0 | 1024 | 1.0 | 90 | 0.62 |
| Comparative 11 | 16 | 1.0 | — | — | — | — |
| Comparative 12 | 16 | 1.0 | 1024 | 0.5 | 40 | 0.62 |
| Example 13 | 16 | 1.0 | 1024 | 0.5 | 90 | 0.62 |
| Example 14 | 16 | 1.0 | 1024 | 0.5 | 120 | 0.62 |
| Comparative 15 | 16 | 1.0 | 1024 | 0.5 | 160 | 0.62 |
| Example 16 | 16 | 1.0 | 1024 | 0.5 | 90 | 0.50 |

TABLE 1-continued

| Sample Tube | Original Tube Portion: External Diameter (mm) | Original Tube Portion: Thickness (mm) | Processed Portion: Fin Number (/m) | Processed Portion: Fin Height (mm) | Processed Portion: Groove Angle α (° ) | Processed Portion: Cut-Out Pitch (mm)) |
|---|---|---|---|---|---|---|
| Example 17 | 16 | 1.0 | 1024 | 0.5 | 90 | 0.62 |
| Example 18 | 16 | 1.0 | 1024 | 0.5 | 90 | 0.82 |
| Comparative 19 | 16 | 1.0 | 1024 | 0.5 | 90 | 1.20 |

Figure 3A:
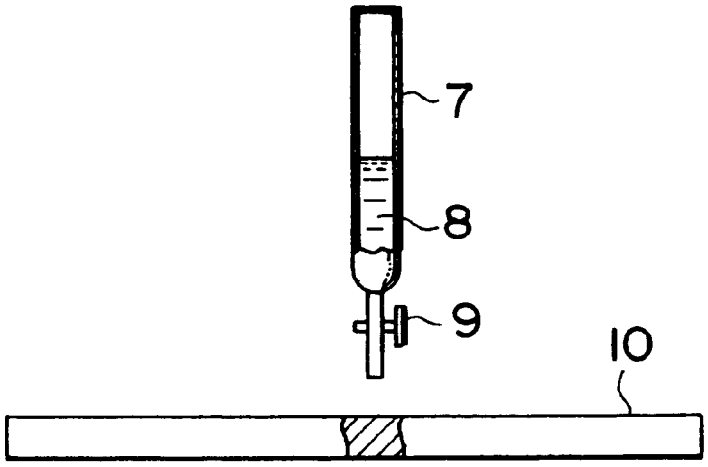
FIG. 3A is a diagrammatic illustration showing an equipment for measuring a wetting and spreading ability of the heat exchanger tube.
Figure 3B:
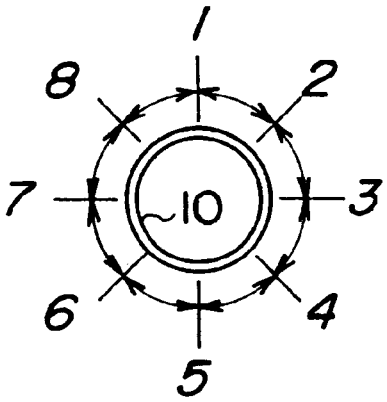
FIG. 3B is a diagrammatic illustration showing measuring points of the wetting and spreading ability of a refrigerant on the heat exchanger tube.
Figure 4:
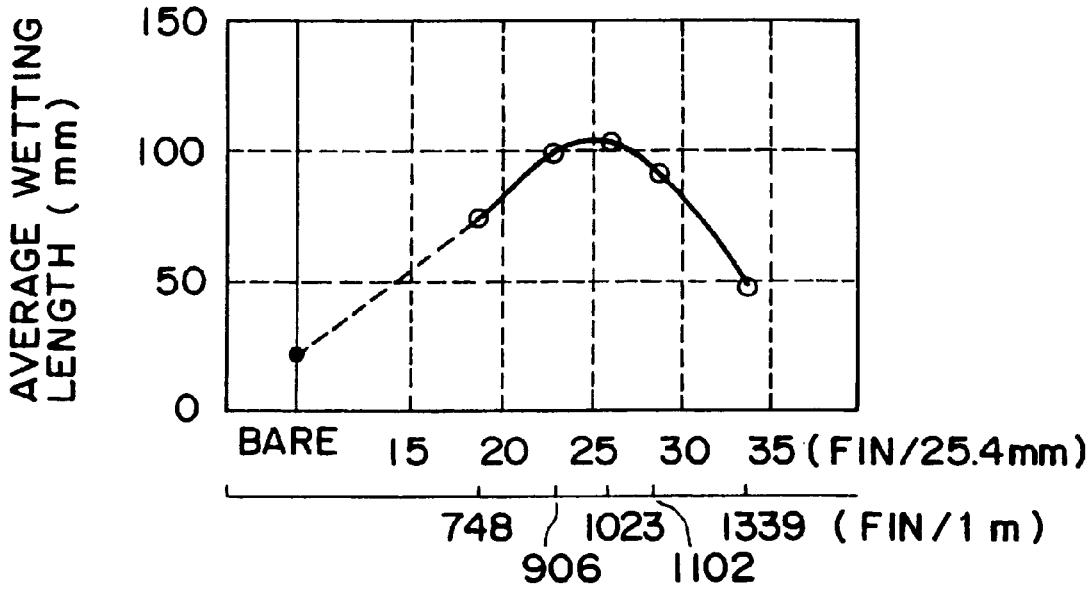
FIG. 4 is a graph showing a relationship between number of fins and an average wetting length.

With respect to these sample tubes, the wetting and spreading ability was checked. FIG. 3A is a diagrammatic illustration of a testing equipment used for checking the wetting and spreading ability. In order to remove fat from the surface of the sample tubes, the sample tubes were dipped in trichloroethane for an hour. Thereafter, a heating process was performed for heating at 200 ° C. for one hour under oxidation atmosphere. The sample tubes 10 thus processed were placed orienting the axis horizontally. A pipette 7 is fixed above the sample tube thus positioned so that the tip end of the pipette 7 was positioned above substantially the center portion of the tube 10 at a distance of 20 mm. Water colored by an ink was filled in the pipette 7. By adjusting a cock 9, 2 cc of the colored water was dropped onto the sample tube 10. Thereafter, at 8 positions illustrated in FIG. 3B, the wetting and spreading lengths were measured, and an average wetting and spreading length was derived from the results of measurement. FIG. 4 is a graph taking the number of fins per 25.4 mm of axial length on the horizontal axis and the average wetting and spreading length on the vertical axis to show the relationship therebetween. As can be seen, the best wetting and spreading length was attained at approximately 25 fins per 25.4 mm (980 fins per 1 m) of the axial length. Sufficiently long wetting and spreading length was attained in the range of number of fins 23 to 28 per 25.4 mm (approximately 905 to 1102 fins per 1m).

Figure 5:
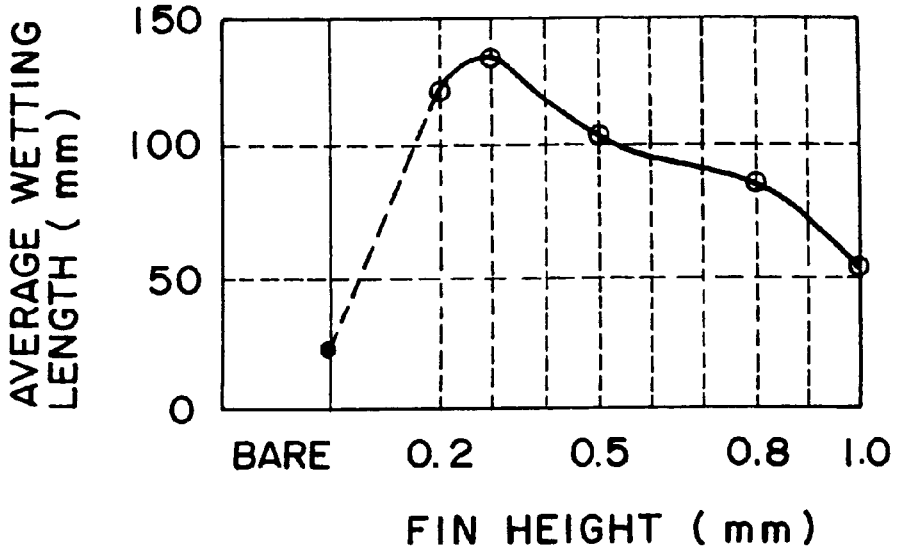
FIG. 5 is a graph showing a relationship between a height of the fin and the average wetting length.

FIG. 5 is a graph showing a relationship between the height of the fin and the average wetting and spreading lengths with taking the fin height on the horizontal axis and the average wetting and spreading length on the vertical axis. As can be clear from FIG. 5, lower fin heights results in longer wetting and spreading length. However, the wetting and spreading length is abruptly decreased when the fin height is less than 0.2 mm. In the fin height range of 0.2 to 0.8 mm, satisfactory wetting and spreading length can be attained.

Figure 6:
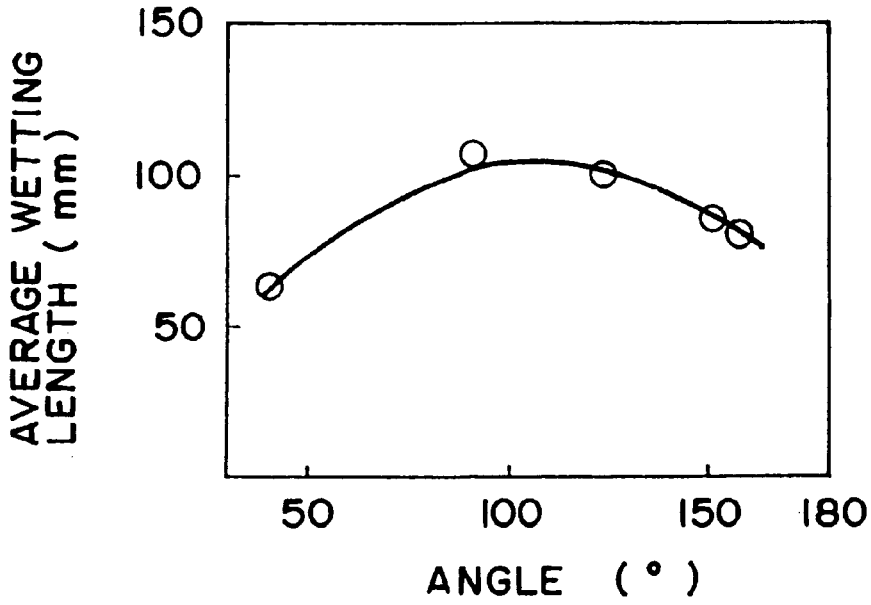
FIG. 6 is a graph showing a relationship between an angle defined by peripheral walls of a groove formed in the tip end portion of the fin and the average wetting length.

FIG. 6 is a graph showing a relationship between the angle α defined by the inner peripheral walls of the groove and the average wetting and spreading length with taking the angle α on the horizontal axis and the average wetting and spreading length on the vertical axis. As can be seen, the best wetting and spreading length was attained at the angle of 90°. The wetting and spreading length becomes unsatisfactory at the angular range less than 70° and greater than 150°.

Figure 7:
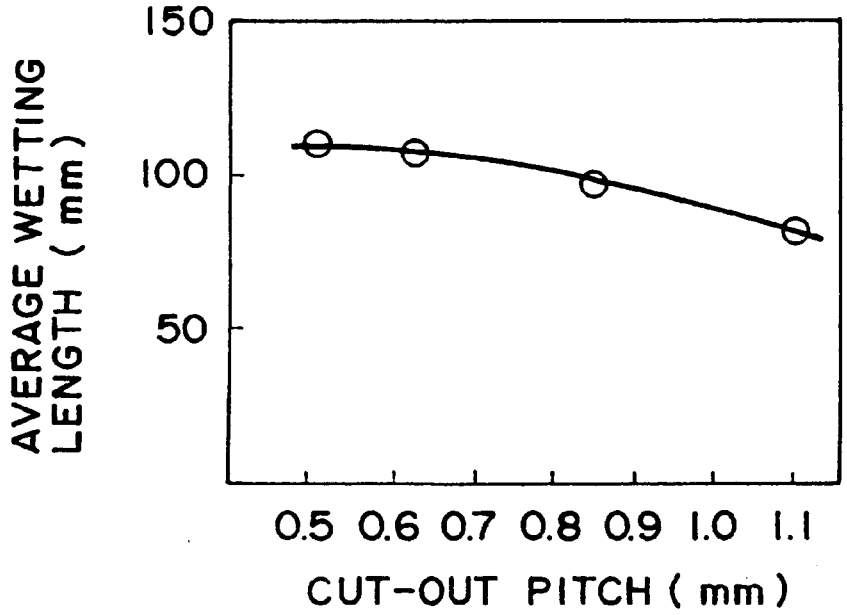
FIG. 7 is a graph showing a relationship between a pitch of cut-outs formed in the tip end portion of the fin and the average wetting length.

FIG. 7 is a graph showing a relationship between the circumferential pitch of the cut-outs and the average wetting and spreading length with taking the circumferential pitch of the cut-outs on the horizontal axis and the average wetting and spreading length on the vertical axis. As can be seen, the shorter pitch of the cut-outs results in longer wetting and spreading length. When the pitch exceeds 1.0 mm, the wetting and spreading length becomes unacceptably short. However, since the shorter pitch of the cut-outs less than 0.5 mm is practically too difficult to employ.

Next, an evaporation performance of the shown examples and comparative examples of heat exchanger tubes for the falling film evaporator was measured. Namely, the shown example of the heat exchanger tube according to the present invention was produced in the dimension shown in the following table 2. It should be noted that the examples 20 and 21 are the same configurations to the foregoing examples 3, 8, 13 and 17.

TABLE 2

| Sample Tube | Original Tube Portion: External Diameter (mm) | Original Tube Portion: Thickness (mm) | Processed Portion: Fin Number (/m) | Processed Portion: Fin Height (mm) | Processed Portion: Groove Angle α (° ) | Processed Portion: Cut-Out Pitch (mm)) |
|---|---|---|---|---|---|---|
| Example 20 | 16 | 1.1 | 1024 | 0.5 | 90 | 0.62 |
| Example 21 | 16 | 1.1 | 1024 | 0.3 | 90 | 0.62 |
| Prior Art 22 | 16 | 1.1 | 1417 | 1.0 | — | — |
| Prior Art 23 | 16 | 1.1 | — | — | — | — |

Figure 8:
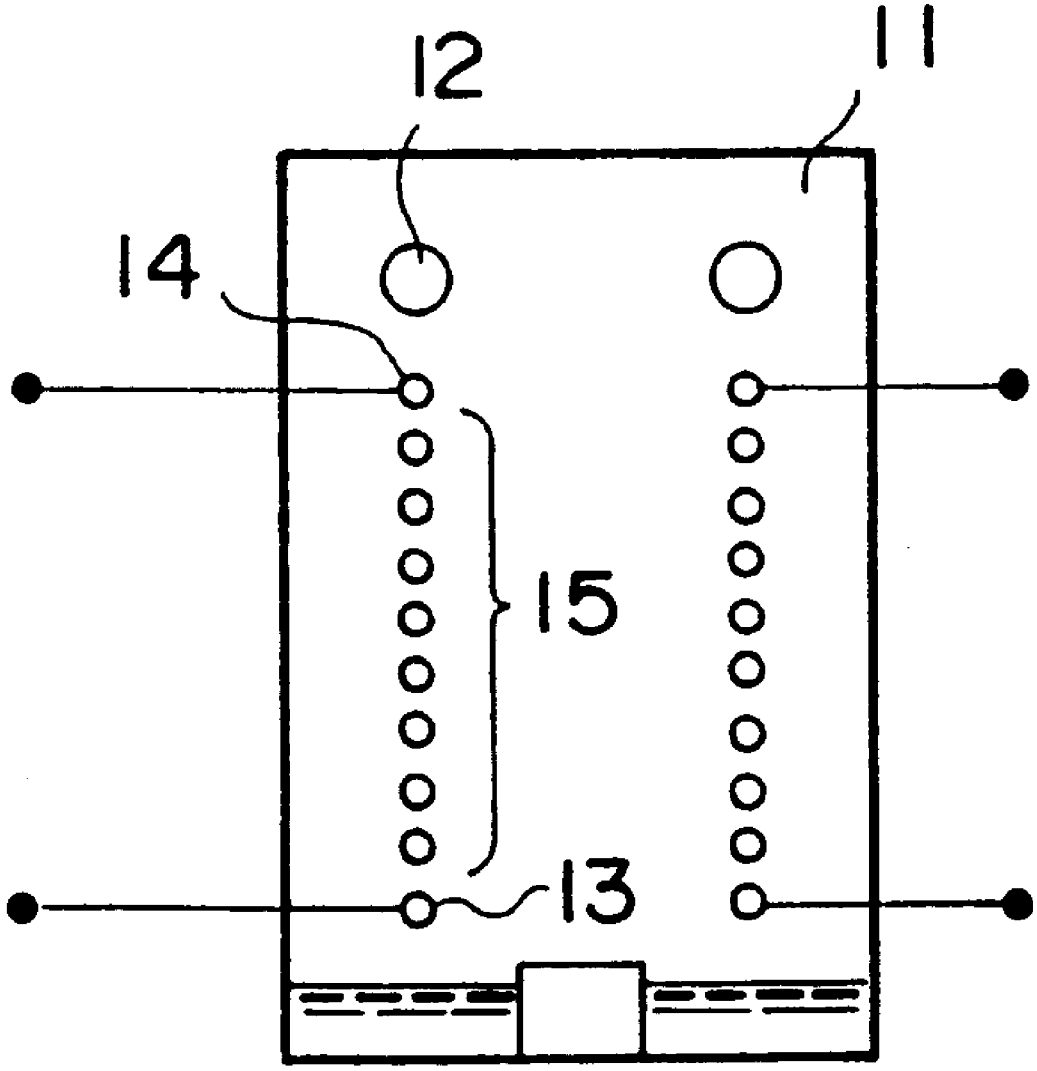
FIG. 8 is a diagrammatic section in the axial direction of the shown embodiment of the heat exchanger tube.

With respect to these sample tubes, the evaporation performances were tested. FIG. 8 shows a testing equipment used for measuring the evaporation performance. The sample tubes were arranged in single column x stages. Above the sample tube group 15, a refrigerant discharge pipe 12 was arranged. The lower end of the sample tube group 15 was connected to a cool water inlet 13 to circulate the cool water through the sample tubes. On the other hand, the upper end of the sample tube group 15 was connected to a cool water outlet 14. In the shown testing equipment, an absorbing portion 11 was provided for adjusting a vapor pressure within the equipment. In the test, water was used as the refrigerant. The vapor pressure in the equipment was adjusted by the absorbing portion 11 so that the cool water at a temperature of approximately 12° C. at the cool water inlet 13 was discharged from the cool water outlet 14 at a temperature of approximately 7° C. The flow rate of the cool water within the evaporator tube was 1.5 m/sec. After setting the initial condition of the cool water temperature and the internal temperature in the equipment uniform, the refrigerant is sprayed on the sample tube group 15 by the refrigerant discharge pipe 12 in a flow velocity of 0.7 to 1.3 liter/m.min. Then, the heat transmission performance was measured.

Figure 9:
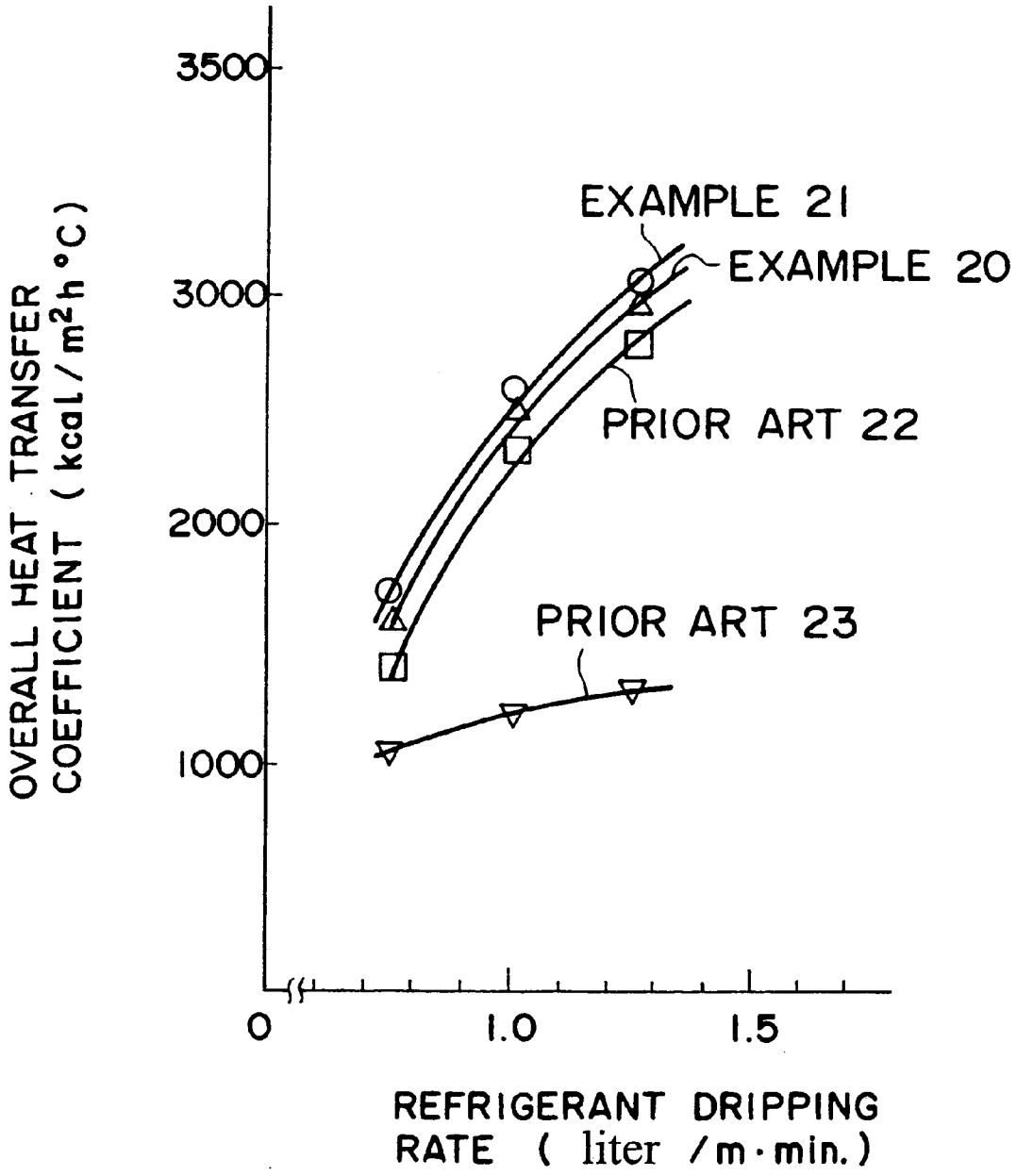
FIG. 9 is a graph showing comparison of heat transmission performance between the shown embodiment of the heat exchanger tube and the conventional heat exchanger tube.
Figure 10:
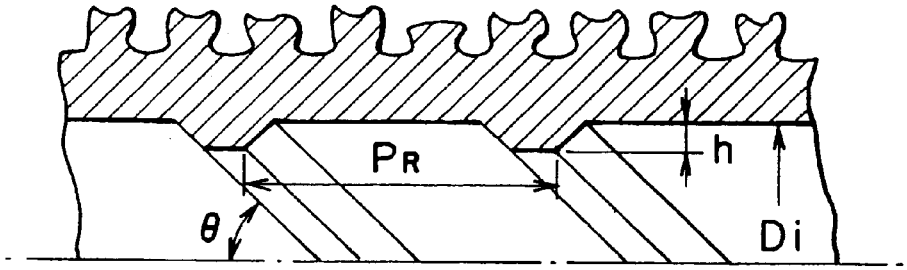
FIG. 10 is a diagrammatic section in the axial direction of the shown embodiment of the heat exchanger tube.

FIG. 9 shows a relationship between a refrigerant dripping rate (liter/m.min.) and an overall heat transfer coefficient (kcal/m$^2$h°C.) with taking the refrigerant dripping rate on the horizontal axis and the overall heat transfer coefficient on the vertical axis. As can be seen from FIG. 9, the example 20 achieved the unitary heat transmission coefficient 2.2 times greater than that of the smooth tube of the prior art example 23, and also greater than the low fin tube of the prior art example 23. On the other hand, the example 21 achieved the overall heat transfer coefficient 2.3 times of the prior art example 23 and thus shows higher heat transfer performance than that of the example 20.

Next, the evaporation performance was checked for the sample tube which was provided ribs on the inner periphery of the tube. The external configuration of the tube was the same as the example 6, in which number of fins per 1 m of axial length of the tube was 1024 (26 columns per inch.), the fin height was 0.3 mm, the angle $\alpha$ defined by the inner periphery of the groove was 90°, and the pitch of the cut-outs was 0.62. The performance was tested with varying the configuration of the ribs within the tube. The evaluating condition of the heat transmission was that the refrigerant discharge amount was 1.0 liter/m.min., the cool water temperature at the cool water inlet at approximately 12°C. and at the cool water discharge output at approximately 7°, the flow velocity of the cool water was 1.5 m/sec.

Figure 11:
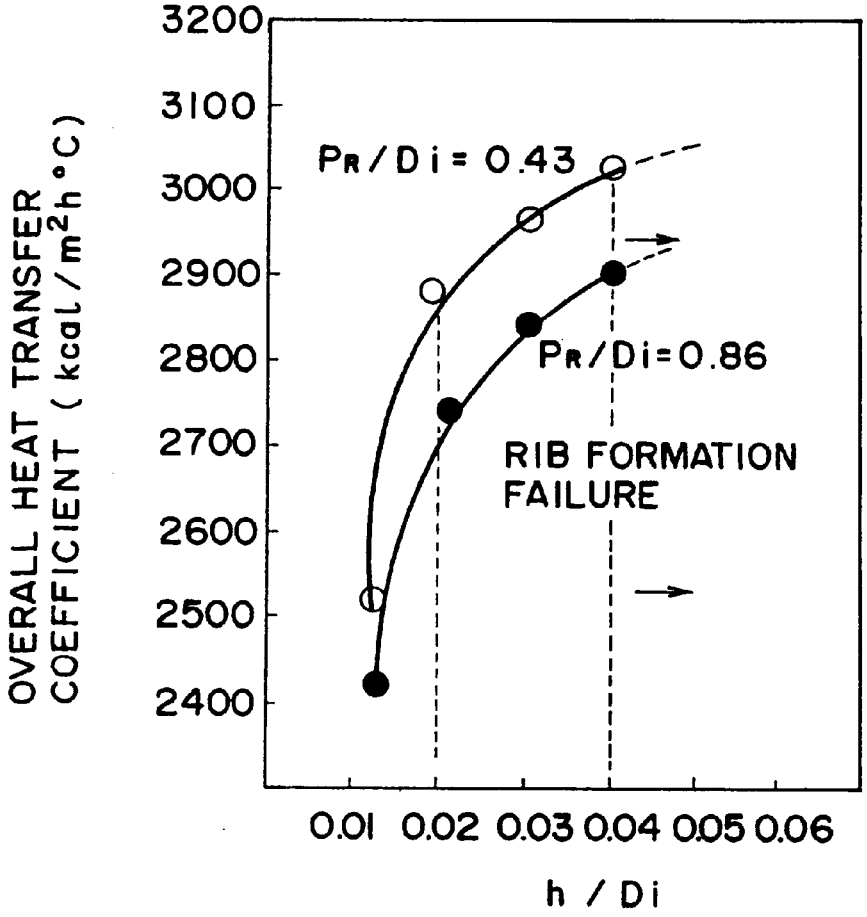
FIG. 11 is a graph showing a relationship between h/Di and a unitary heat transmission coefficient.

FIG. 11 shows a relationship between h/Di and the overall heat transfer coefficient with taking h/Di on the horizontal axis and the overall heat transfer coefficient. In this case, $P_R$/D was in 0.43 to 0.86. When h/Di becomes smaller than 0.02, decreasing rate of the overall heat transfer coefficient becomes greater. On the other hand, when h/Di is greater than 0.04, a difficulty in formation should be encountered. Therefore, by maintaining h/Di within a range of 0.02 to 0.04, the overall heat transfer coefficient is increased and formation can be performed without any problem. It should be noted that it is further preferred to maintain h/Di within a range of 0.022 to 0.035.

Figure 12:
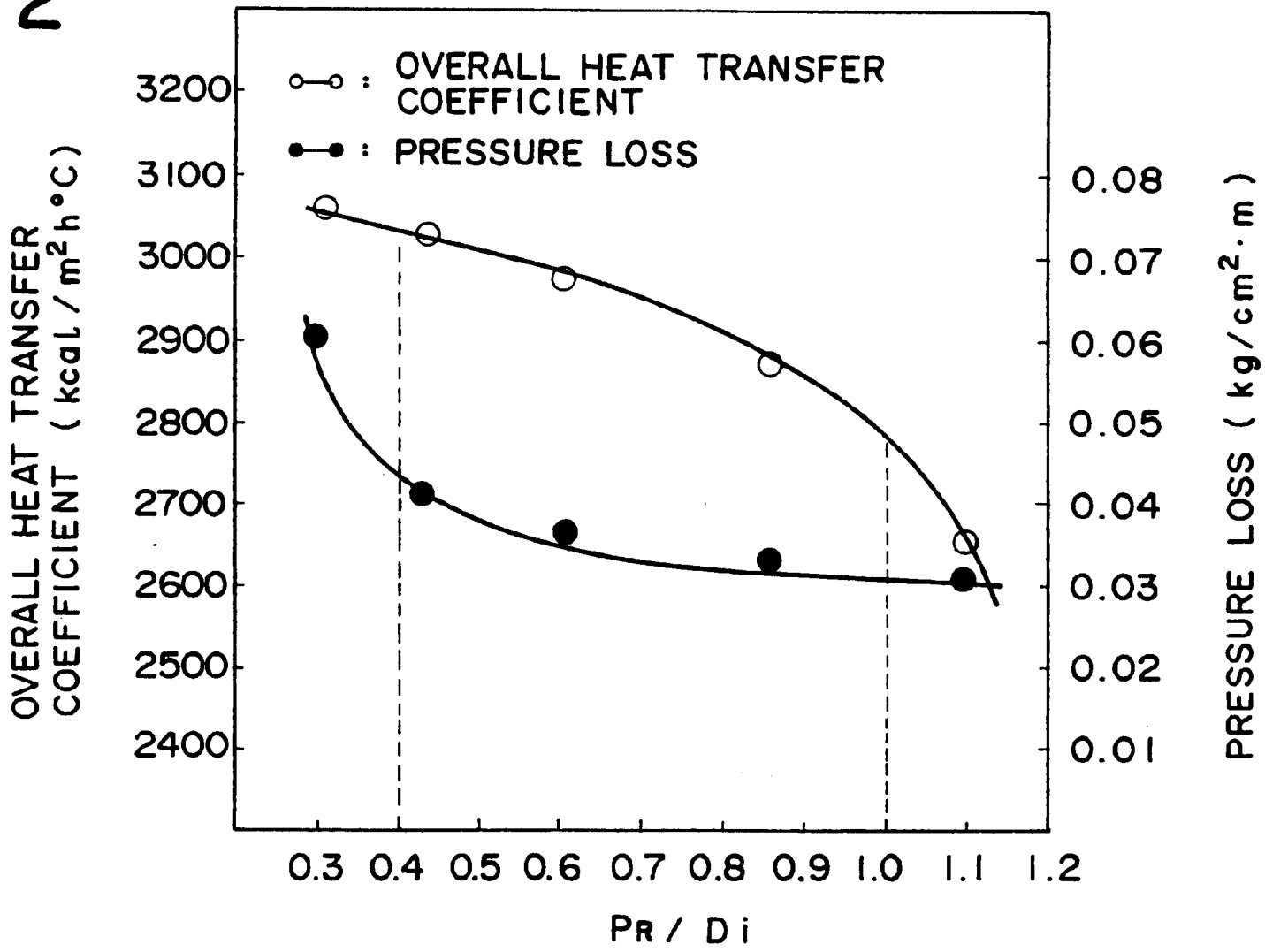
FIG. 12 is a graph showing a relationship between $P_R$/Di and the overall heat transfer coefficient.

FIG. 12 shows the overall heat transfer coefficient and a pressure loss. In this case, h/Di is maintained at 0.03. When $P_R$/Di becomes smaller than 0.4, the pressure loss is increased beyond increasing rate of the overall heat transfer coefficient. On the other hand, when $P_R$/Di becomes greater than 1, the overall heat transfer coefficient is significantly lowered. Accordingly, $P_R$/Di is preferably selected to be in a range of 0.4 to 1.0.

Although the invention has been illustrated and described with respect to exemplary embodiment thereof, it should be understood by those skilled in the art that the foregoing and various other changes, omissions and additions may be made therein and thereto, without departing from the spirit and scope of the present invention. Therefore, the present invention should not be understood as limited to the specific embodiment set out above but to include all possible embodiments which can be embodies within a scope encompassed and equivalents thereof with respect to the feature set out in the appended claims.

What is claimed is:

1. A heat exchanger tube for a falling film evaporator with a cooling medium of water comprising:

a tube body;

fins provided on an outer periphery of said tube body and extending in a direction transverse or oblique to an axial direction of said tube, said fins being provided in a density to have 905 to 1102 in number of fins per 1 m in the axial direction, and having heights in a range of 0.2 to 0.8 mm. wherein said fins include a tip end;

grooves formed in the tip end of said fins and extending substantially along said fins, said grooves including mutually opposing inner peripheral wall surfaces, the mutually opposing inner peripheral wall surfaces of said groove defining an angle within a range of 70° to 150 °;

cut-outs formed in said tip end of said fins in alignment in a transverse direction to the fin, said cut-outs being provided at a pitch in a range of 0.5 to 1.0 mm in a circumferential direction of the tube body.

2. A heat exchanger tube for falling film evaporator as set forth in claim 1, which further comprises at least one rib provided on an inner periphery of said tube body and extending oblique to an axis of the tube, said rib having a height h establishing a ratio h/Di with a maximum internal diameter Di within a range of 0.02 to 0.04, and said rib further having a pitch $P_R$ of said rib establishing a ratio within a range of 0.4 to 1.0.

3. A heat exchanger tube for cooling a cooling object fluid flowing through said tube by heat exchange with a cooling medium of water discharged onto an external surface of said tube, comprising:

a tube body;

at least one fin surrounding the external surface of said tube at a predetermined density, said fin having a tip end;

a first cooling medium spreading passage formed in the tip end of said fin and extending substantially in a circumferential direction of said tube, for capturing said cooling medium of water and guiding flow of said cooling medium of water in a first circumferential direction;

a second cooling medium spreading passage formed in the tip end of said fin and intersecting with said first cooling medium spreading passage for capturing the cooling medium of water and guiding flow of said cooling medium of water in a second direction at an angle with respect to said first circumferential directions wherein said at least one fin has a height of between 0.2 mm and 0.8 mm.

4. A heat exchanger tube as set forth in claim 3, wherein said fin extends in spiral fashion on a periphery of said tube body with a predetermined pitch satisfying said predetermined density, and said second cooling medium spreading passage is interrupted by an interval between adjacent fin portions.

5. A heat exchanger tube as set forth in claim 3, wherein said fin comprises a plurality of essentially annular fins arranged at said predetermined density, and said second cooling medium spreading passage is interrupted by an interval between adjacent fins.

6. A heat exchanger tube as set forth in claim 3, wherein said fin surrounds said tube body in a density to have 905 to 1102 fins within 1 m of axial length.

7. A heat exchanger tube as set forth in claim 3, wherein said first cooling medium spreading passage has a pair of mutually opposing side walls which defines an angle therebetween in a range of 70° to 150°.

8. A heat exchanger as set forth in claim 3, wherein said second cooling medium spreading passages extend substantially in an axial direction of said tube body.

9. A heat exchanger tube as set forth in claim 3, which further comprises an inward projection projecting from an inner surface of said tube body and oriented to cause turbulent flow of said cooling object fluid within said tube body.

10. A heat exchanger tube as set forth in claim 9, wherein said inward projection has a height h establishing a ratio h/Di with a maximum internal diameter Di within a range of 0.02 to 0.04.

11. A heat exchanger tube as set forth in claim 9, wherein said inward projection comprises a rib, and wherein said rib is provided at a pitch $P_R$ of said rib establishing a ratio $P_R$/Di with a maximum internal diameter Di of said tube within a range of 0.4 to 1.0.

* * * * *